United States Patent [19]

Eggers

[11] Patent Number: 4,887,624

[45] Date of Patent: Dec. 19, 1989

[54] APPARATUS FOR TREATING THE INSIDE SURFACE OF TUBULAR MEMBERS WITH LIQUID

[75] Inventor: Detlev Eggers, Neu-Anspach, Fed. Rep. of Germany

[73] Assignee: Metallgesellschaft Aktiengesellschaft, Frankfurt am Main, Fed. Rep. of Germany

[21] Appl. No.: 297,904

[22] Filed: Jan. 17, 1989

[30] Foreign Application Priority Data

Jan. 28, 1988 [DE] Fed. Rep. of Germany ..... 3802428

[51] Int. Cl.[4] ..... B08B 9/02

[52] U.S. Cl. ..... 134/98; 134/99; 134/113; 134/166 R; 134/171; 134/200

[58] Field of Search ..... 134/95, 98, 99, 102, 134/113, 166 R, 169 R, 171, 200; 118/DIG. 10, 317

[56] References Cited

U.S. PATENT DOCUMENTS 2,263,367 11/1941 Peterson ..... 134/171 X

FOREIGN PATENT DOCUMENTS 3005820 9/1981 Fed. Rep. of Germany ... 134/166 R

*Primary Examiner*—Philip R. Coe

*Attorney, Agent, or Firm*—Sprung Horn Kramer & Woods

[57] ABSTRACT

To permit a uniform treatment of tubular members while avoiding pollution of the environment and preventing impairment of laborers, a treating container (1) is provided with supports (2) for the tubular members (3), also with nozzles (6) for connection to one end of each tubular member (3) and with lines (10) for supplying liquid to the nozzles. A cover (4), which is adapted to be swung up, is provided in the front longitudinal wall of the treating container (1) above the supports (2) for the tubes (3). An exhausting device (5), which extends throughout the length of the treating container (1), is provided in the upper portion of the treating container (1). Nozzles (6) for slidably receiving one end of each tubular member (3) are provided on the inside of a side wall (7) of the treating container (1).

5 Claims, 2 Drawing Sheets

APPARATUS FOR TREATING THE INSIDE SURFACE OF TUBULAR MEMBERS WITH LIQUID

BACKGROUND OF THE INVENTION

This invention relates to an apparatus for treating the inside surface of tubular members with liquids, consisting of a treating container provided with supports for the tubular members, nozzles for connection to one end of each tubular member and supply lines for supplying liquids to the nozzles.

In some cases it is necessary to treat the inside surface of tubular members with liquids, such as picklers. The treatment should be as uniform as possible throughout the inside surface. After the treatment the treating liquid must be entirely removed.

Published German application 30 05 820 discloses a treatment of the inside surface of tubular members in which each tubular member is pushed in a separate outer container onto a conical holder and a conical nozzle is then slidably inserted into the other end. The liquid flows through the nozzle into the tubular member and flows out at the other end and then flows between the outside surface of the tubular member and the inside surface of the outer container to an outlet in the outer container. The fitting of the tubular members and their seals in the outer container is an expensive operation and those portions of the tubular members which are covered by the conical nozzle and the conical holder are not pickled or are only poorly pickled.

SUMMARY OF THE INVENTION

It is an object of the invention to permit a perfectly uniform treatment of the inside surface with a minimum expenditure while avoiding pollution of the environment and preventing impairment of laborers.

That object is accomplished in accordance with the invention in that a cover, which is adapted to be swung up, is arranged in the front longitudinal wall of the treating container above the supports for the tubular members, and exhausting device extending throughout the length of the treating container is disposed in the upper portion of the treating container and nozzles are provided on the inside of a side wall of the treating container and adapted to slidably receive one end of each tubular member.

The treating container consists of a vat for collecting the liquid which flows out from the tubular members and of a hood, which is closed on all sides. The supports for the tubular members are disposed above the liquid level in the vat. The supports consist of a plurality of spaced apart bars, which contain notches for receiving the tubular members. The exhausting device is disposed below the top of the hood and serves to exhaust gases from the treating container. The exhausting device preferably consists of a tube, which is formed with a gap or with holes for drawing the gases into the tube. The hinged cover is mounted at its top end in a hinge and with its bottom end extends as far as to the supports for the tubular members. The nozzles communicate through the side wall with lines for supplying liquid and possibly air. The tubular members are slidably inserted into the nozzles by hand. The length of the treating container is so selected that the liquid flowing out of the free ends of the tubular members will not splash against the side wall of the treating container but will flow as a jet into the vat. When the cover is open, the tubular members are slidably inserted into the nozzles; then the cover is closed, the treating liquid is conducted through the tubular members, the tubular members are optionally rinsed, residual liquid is blown out with compressed air, the cover is opened, and the tubular members are pulled out of the nozzles and removed from the treating container. If the tubular members are subsequently intended to be treated on their outside surface, the tubular members may be directly transferred to the stages for further treatment through an opening in the rear wall of the treating container.

In a preferred embodiment the hinge for the hinged cover is arranged so far to the rear that liquid will drip into the rear portion of the treating container when the cover is open. In that case the cover is rearwardly inclined from the front side of the vat as far as to the hinge. As a result, droplets from the swung up cover will fall into the rear portion of the treating container so that the operators will substantially be protected as they take out the tubular members.

In a preferred embodiment an air-blasting device, which extends throughout the length of the treating container, is disposed approximately on the level of the supports on the front side of the treating container. The blasting device suitably consists of a tube, which is formed with a series of nozzle orifices, which are upwardly inclined and directed to the exhausting device. This will result in the formation of a veil of air, which prevents an escape of vapors when the cover is open. The veil of air may be formed permanently or, in order to save compressed air, may be formed only when the cover is open. This may be controlled by switch contacts, which are actuated by the cover.

In a preferred embodiment the nozzles are connected by a line to a diaphragm valve and to a pump that is connected to a tank for the treating liquid and a second line provided with a second diaphragm valve and serving to inject compressed air into the line between the nozzles and the diaphragm valve. The diaphragm valve opens automatically as the pump is started and is automatically closed when the pump is turned off after the predetermined treating time. As the diaphragm valve is closed the second diaphragm valve is automatically opened to supply air for blowing out the tubular members into the latter at an adjustable rate and under a controllable pressure. The second diaphragm valve is automatically closed when the blowing-out time has elapsed. The entire control may obviously be effected also by hand.

In a preferred embodiment, the further diaphragm valve is connected to a device for indicating that the time for blowing compressed air has elapsed.

The invention will now be explained more in detail with reference to the drawings, wherein

DETAILED DESCRIPTION OF THE INVENTION

Figure 1:
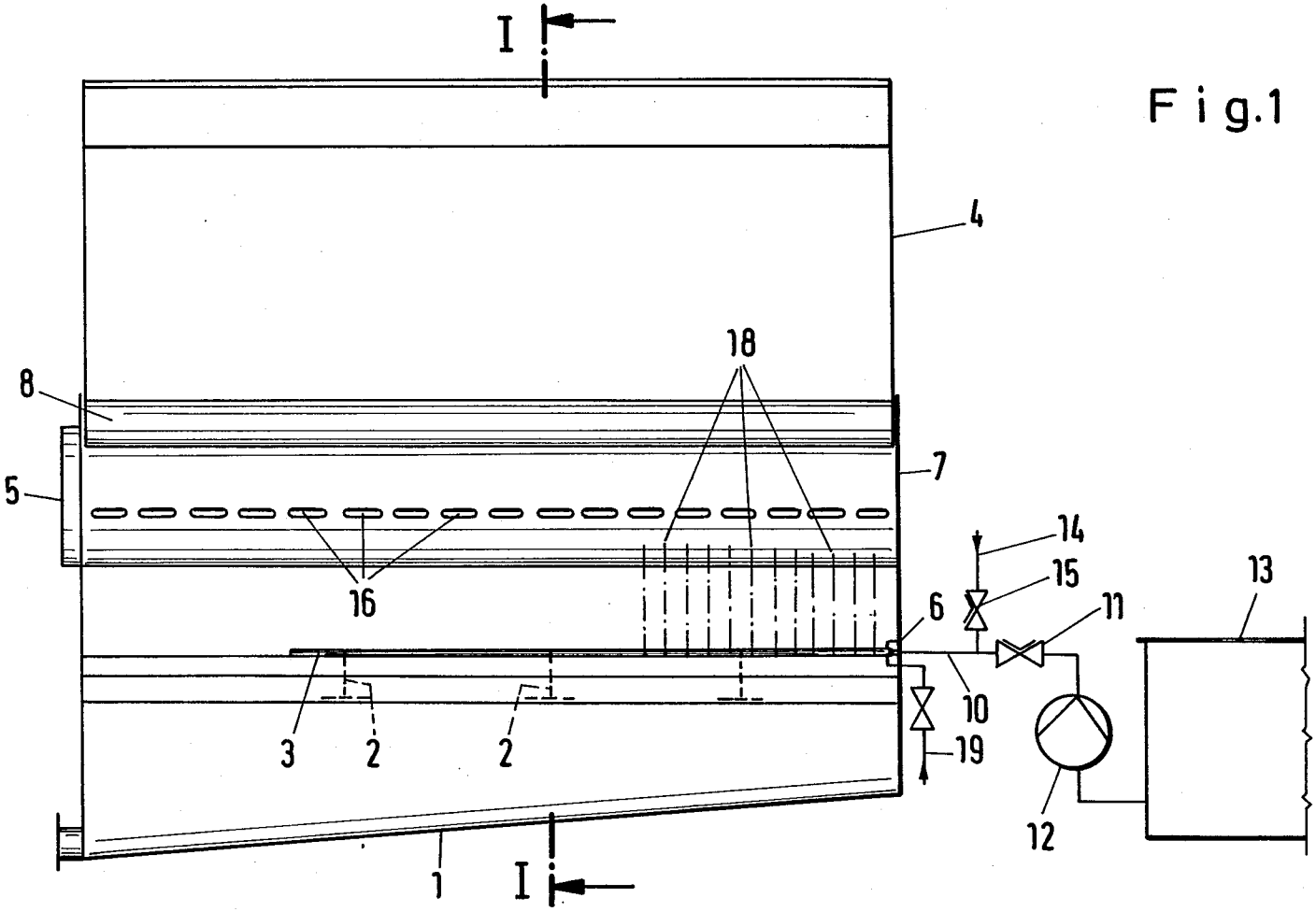
FIG. 1 shows the apparatus according to the invention.

The supports 2 for the tubular members 3 are arranged in the treating container 1. A cover 4 is arranged in the front longitudinal wall of the treating container 1 above the supports 2 and can be swung up (dotted lines in FIG. 2). An exhausting device 5 consisting of a tube formed with slots 16 is provided in the upper portion of the treating container 1. Nozzles 6 are provided on the inside surface of the side wall 7 and serve to slidably receive one end of each tubular member 3. The tubular members 3 lie in notches formed in the supports 2. The hinge 8 for the cover 4 is disposed so far to the rear in the upper portion of the treating container 1 that when the cover 4 is open it will be sufficiently spaced from the front side of the treating container 1 so that dripping liquid will drip into the rear portion of the treating container 1. An air-blasting device 9 consisting of a tube formed with nozzle orifices 17 is provided on the front side of the treating container 1. The air which has been injected forms a veil 18 of air, which is upwardly inclined and directed toward the exhausting device 5. The compressed air is supplied through the line 19 into the blasting device 9. The nozzles 6 communicate through line 10, diaphragm valve 11 and pump 12 with the tank 13, in which treating liquid is stored. A second line 14 containing a second diaphragm valve 15 opens into the line 11 and serves to blow compressed air into the nozzles 6 in order to scavenge the tubular members.

Figure 2:
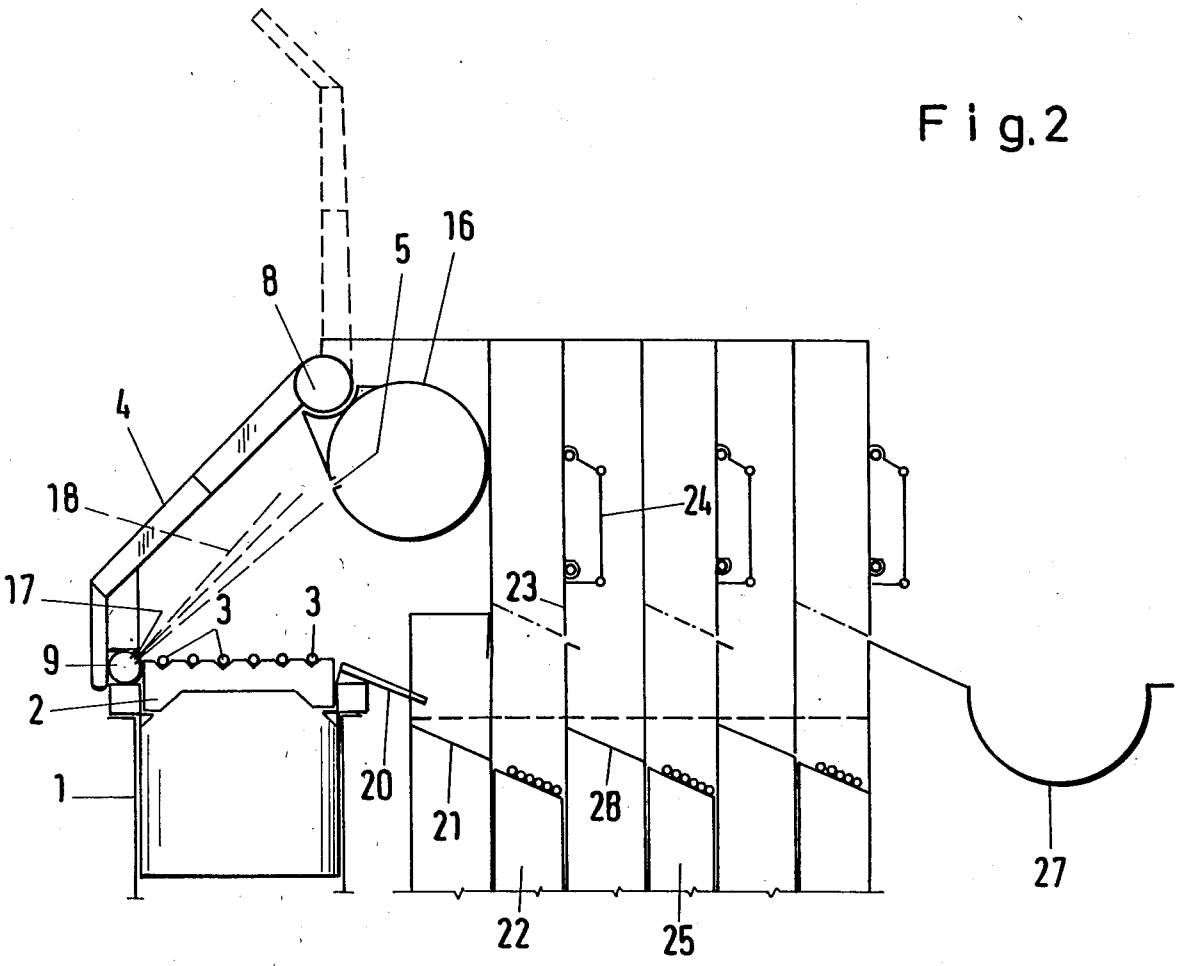
FIG. 2 is a section view along line I—I in FIG. 1.

FIG. 2 shows a succeeding three-stage washing plant in accordance with U.S. patent application Ser. No. 91,634 filed Sept. 1, 1987, and now U.S. Pat. No. 4,830,676. The tubular members are pulled out of the nozzles and placed on the inclined chute 20. From the latter, the tubular members fall into the rinsing liquid with one end moving ahead so that the tubular members are entirely filled with washing liquid. From the inclined receiving surface 21 the tubular members roll onto the supporting body 22, which is provided with a separate lifting and lowering device at each of its two ends. The supporting body 22 is slightly raised and lowered by means of the lifting and lowering device so that the tubular members are reciprocated. The supporting body and the tubular members lying thereon are subsequently raised to the position indicated by dotted lines. By means of the linkage 24, the flap 23 is opened so that the tubular members roll from the top surface of the supporting member 22 onto the inclined delivery chute 28 and fall from the latter, with one end moving ahead, onto the oblique receiving surface 25, from which they roll onto the supporting member 26. That second washing stage and the succeeding third washing stage are operated like the first washing stage. Behind the last washing stage the tubular members roll into the receiving device 27.

What is claimed is:

1. An apparatus for treating an inside surface of tubular members with liquids, comprising a treating container including supports for holding the tubular members in a longitudinal direction, nozzles connectable to one end of each tubular member when supported in the container; supply lines for supplying liquids to the nozzles; wherein the container further comprises a cover at a front longitudinal wall of the treating container parallel to the longitudinal direction and above the supports for the tubular members, means mounting the cover for pivotal movement about an axis parallel to the longitudinal direction and upwardly from a closed position to an open position; an exhausting device extending throughout the length of the treating container in the longitudinal direction and disposed in an upper portion of the treating container, and wherein the nozzles are disposed on the inside of the one side wall of the treating container, wherein the one side wall is perpendicular to the longitudinal direction and each nozzle has means for slidably receiving one end of each tubular member to dispose each nozzle coaxial with the received tubular member.

2. An apparatus according to claim 1, wherein the means pivotally mounting the cover comprises a hinge at the pivot axis disposed toward a rear wall of the container behind the supported tubular member such that liquid will drip into a rear portion of the treating container when the cover is moved to the open position.

3. An apparatus according to claim 1, further comprising an air-blasting device extending throughout the length of the treating container in the longitudinal direction and disposed approximately at a level of the supports at a front portion of the treating container.

4. An apparatus according to claim 1, further comprising a first diaphragm valve connected to the nozzles by a first line connected to a tank for the treating liquid and a second line and a second diaphragm valve for injecting compressed air into the first line between the nozzles and the first diaphragm valve.

5. An apparatus according to claim 4, further comprising a device for indicating that the time for blowing compressed air has elapsed connected to the second diaphragm valve.

* * * * *